United States Patent [19]

Häupl

[11] Patent Number: 4,640,198

[45] Date of Patent: Feb. 3, 1987

[54] AXLE CONTROL MECHANISM FOR RAIL VEHICLES

[75] Inventor: Otmar Häupl, Kassel, Fed. Rep. of Germany

[73] Assignee: Thyssen Industrie Aktiengesellschaft, Essen, Fed. Rep. of Germany

[21] Appl. No.: 646,417

[22] Filed: Aug. 31, 1984

[30] Foreign Application Priority Data

Sep. 1, 1983 [DE] Fed. Rep. of Germany ..... 3331559

[51] Int. Cl.[4] ..... B61F 5/30; B61F 5/38

[52] U.S. Cl. ..... 105/168; 105/218.1

[58] Field of Search ..... 105/165, 167, 168, 169, 105/170, 218 R, 224 R

[56] References Cited

U.S. PATENT DOCUMENTS

| | | | |
|---|---|---|---|
| 4,175,494 | 11/1979 | Moser | 105/168 X |
| 4,233,910 | 11/1980 | Schumacher | 105/168 X |
| 4,238,006 | 12/1980 | Jackson et al. | 105/168 X |
| 4,289,075 | 9/1981 | Smith | 105/168 X |
| 4,440,094 | 4/1984 | Levy | 105/168 X |
| 4,519,329 | 5/1985 | Vacher | 105/168 X |

FOREIGN PATENT DOCUMENTS

| | | | |
|---|---|---|---|
| 850623 | 9/1952 | Fed. Rep. of Germany | 105/168 |
| 125853 | 5/1928 | Switzerland | 105/168 |

*Primary Examiner*—Robert B. Reeves
*Assistant Examiner*—David F. Hubbuch
*Attorney, Agent, or Firm*—Becker & Becker, Inc.

[57] ABSTRACT

Axle control mechanism for rail vehicles having two or more axles. The two journal boxes of one wheel set are interconnected with the respectively opposed journal boxes of the other wheel set by a hydraulic system. A movement of one of the wheel sets brings about a movement of the other wheel set. Each journal box housing of the two wheel sets is connected by a hydraulic cylinder, which has a double acting piston and is disposed in the longitudinal direction of the truck or undercarriage frame, to this truck or undercarriage frame. Of the two hydraulic cylinders located on the same longitudinal side of the truck or undercarriage frame, one working chamber of one of these hydraulic cylinders is interconnected with the opposed working chamber of the other hydraulic cylinder, and vice versa, via hydraulic lines. A piston movement in one of the in-line and successively arranged hydraulic cylinders brings about an oppositely directed piston movement in the other hydraulic cylinder, thus accomplishing opposite turning movements of the two wheel sets.

6 Claims, 2 Drawing Figures

AXLE CONTROL MECHANISM FOR RAIL VEHICLES

BACKGROUND OF THE INVENTION

1. Field of the Invention

The present invention relates to an axle control or steering mechanism for rail vehicles having two or more axles, according to which the two journal boxes or axle suspensions of one wheel set are interconnected with the respectively opposed journal boxes of the other wheel set by a hydraulic system, and according to which a movement of one of the wheel sets brings about a movement of the other wheel set.

2. Description of the Prior Art

An axle control mechanism of this general type is known from German Patent No. 11 56 835. However, only transverse movements of the wheel sets are possible with this heretofore known construction, according to which the opposed journal boxes of two wheel sets are connected by diagonally disposed hydraulic lines. Furthermore, the hydraulic connecting lines, which cross one another, considerably adversely affect the space which is available in the truck or bogie frame for accommodating units including motors, gear boxes, drive shafts, etc.

German Patent No. 16 058 26 (FIG. 7) discloses a design for the turning movements of two wheel sets, according to which a diagonal arrangement of hydraulic connecting lines between the two wheel sets is also utilized. In addition to the diagonal hydraulic lines, additional hydraulic lines are provided along the truck frame between the journal boxes of one of the wheel sets and the journal boxes of the other wheel set on the same side of the truck. The drawback to this design is that the additional hydraulic lines on both sides not only adversely affect the transverse movements of the two wheel sets, but also require a greater expense.

An an object of the present invention is to provide an axle control mechanism of the aforementioned general type which makes possible opposing turning movements and transverse movements of the two wheel sets, and which retains the space which is available for accommodating other units in the truck or undercarriage frame.

SUMMARY OF THE INVENTION

The axle control or steering mechanism of the present invention is characterized primarily by the following features:

(a) each journal box housing of the two wheel sets is connected to the truck frame by means of a hydraulic cylinder which has a double acting piston and is disposed in the longitudinal direction of the truck;

(b) each hydraulic cylinder has a working chamber comprising an inner chamber portion connected to the truck frame and an outer chamber portion on the opposite side of the piston; of the two hydraulic cylinders disposed on the same longitudinal side of the truck frame, an inner chamber portion of one is connected to the outer chamber portion of the other, and vice versa, by hydraulic lines; and (c) a piston movement in one of the in-line and successively disposed hydraulic cylinders brings about an oppositely directed piston movement in the other hydraulic cylinder, so that opposite turning movements of the two wheel sets can be accomplished.

Pursuant to further features of the present invention which can be used in conjunction with the above, the points of attachment of the hydraulic cylinders and of the associated piston rods can be Cardanic and flexible. The hydraulic system on each longitudinal side of the truck frame can be connected, through the interposition of a control valve, to a reservoir for hydraulic pressure medium. A relief valve may be installed in each connecting line of the hydraulic systems located on both sides of the truck frame. Each hydraulic system may have at least one connecting line which is provided with a flow restrictor or control device. One of the connecting lines in each of the hydraulic systems may comprise two line sections in which there is interposed an intermediate hydraulic cylinder, the double acting piston of which is provided with a piston rod which passes entirely through, with those ends of the piston rods which face one another being functionally connected with a mechanical spring element which achieves a synchronization of the piston movements in the four hydraulic cylinders.

The truck frame may be supported on the journal box housings of the wheel sets via flexicoil coiled springs.

The advantages achieved with the present invention consists in particular in that the space required for the installation of the hydraulic axle control mechanism is greatly reduced, so that the inventive axle control mechanism can also be used for trucks or undercarriages having Cardan-shaft drives or hollow universal-joint shaft drives. The transverse movements of the journal boxes of the wheel sets relative to the truck or undercarriage frame are effected only against the return forces of the flexicoil coil springs; the hydraulic portion of the axle control mechanism is not significant in this connection.

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

Figure 1:
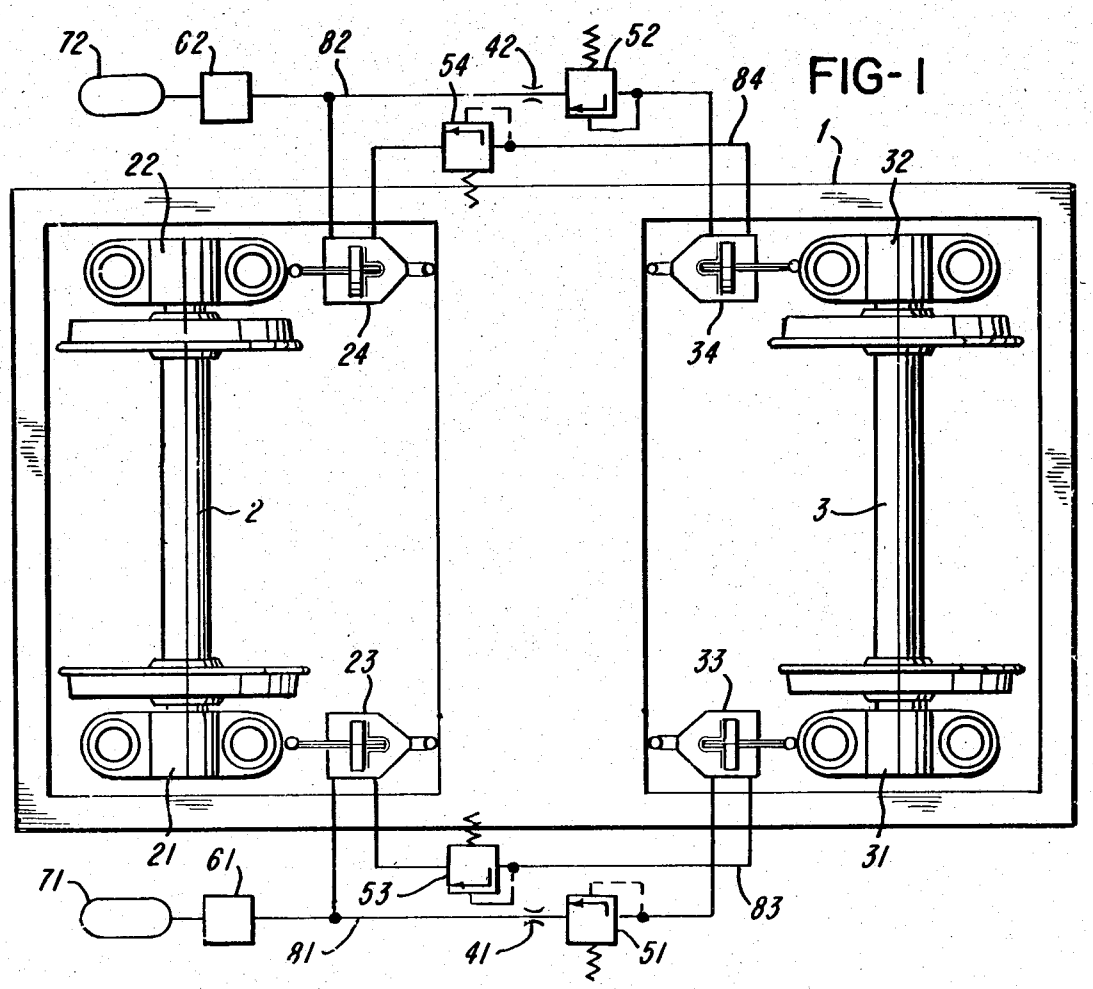
FIG. 1 is a plan view which schematically illustrates a truck frame with two wheel sets and one embodiment of the inventive hydraulic axle control mechanism.

Referring now to the drawings in detail, corresponding reference numerals are used for the same parts in the two embodiments illustrated.

The truck or bogie frame 1, which has a transverse central support, is supported via non-illustrated flexicoil coil springs on the pedestal or journal box housings 21 and 22 or 31 and 32 of the two wheel sets 2 and 3. The journal box housings, along with the coil springs disposed thereon, via which the transverse movements of the wheel sets are effected, are shown for ease of illustration within the frame 1, although they are disposed therebelow.

Each journal box housing is connected to the truck frame 1 by means of a hydraulic cylinder 23 and 24 or 33 and 34, which is disposed in the longitudinal direction of the frame and has a double acting piston. The points of attachment of these hydraulic cylinders, and the points of attachment of the associated piston rods, are movable and flexible.

The working chambers of the two hydraulic cylinders 23 and 33, or 24 and 34 respectively, disposed on each longitudinal side of the truck frame, are interconnected by hydraulic lines 81 and 83, or 82 and 84, which extend approximately parallel to the longitudinal side of the frame. In this way, the working chamber of one hydraulic cylinder is operatively connected with the opposed working chamber of the in-line facing hydraulic cylinder, and vice versa.

In the embodiment of FIG. 1, there exists a direct communication between those working chambers of the hydraulic cylinders 23 and 33 or 24 and 34 which are remote from the journal box housings, and those working chambers of the in-line hydraulic cylinders disposed successively in the truck frame which face the journal box housings.

With their communicating lines, the interconnected working chambers of the hydraulic cylinders form pressure medium lines, and are thus connected in such a way that a movement of the piston in one of the hydraulic cylinders normally results in an equal movement of the piston in the other hydraulic cylinder in the opposite direction. When, in response to a piston in one of the in-line successively arranged hydraulic cylinders being subjected to pressure, one of the two wheel sets 2 or 3 executes a turning movement, i.e. turns about a vertical axis, the other wheel set is also induced to carry out a turning movement by the hydraulic system, but in the opposite direction of rotation to that of the first wheel set. Due to the opposed rotation of the wheel sets, their radial positioning is first made possible when driving through a curve.

Due to the transfer of force described, during the turning movements of the wheel sets, oppositely directed piston movements result in the two hydraulic cylinders with appropriate compensation of the hydraulic fluid in the working chambers of the cylinders via the connecting lines.

So that the turning movements of the wheel sets 1 and 2 are only possible after a certain applied force has been surpassed, a relief valve 51 and 53, or 52 and 54, is installed in each line 81 and 83 or 82 and 84.

Each of the hydraulic systems disposed on the two longitudinal sides of the truck frame through the interposition of control valves 61 or 62, is connected to a reservoir 71 or 72 for hydraulic pressure medium. With regard to the desirable damping of the transfer of force, one line of each hydraulic system is further provided with a flow restrictor or control device 41 or 42.

The hydraulic cylinders can, if desired, be controlled as a function of an external signal for controlling the axles when driving through curves.

Figure 2:
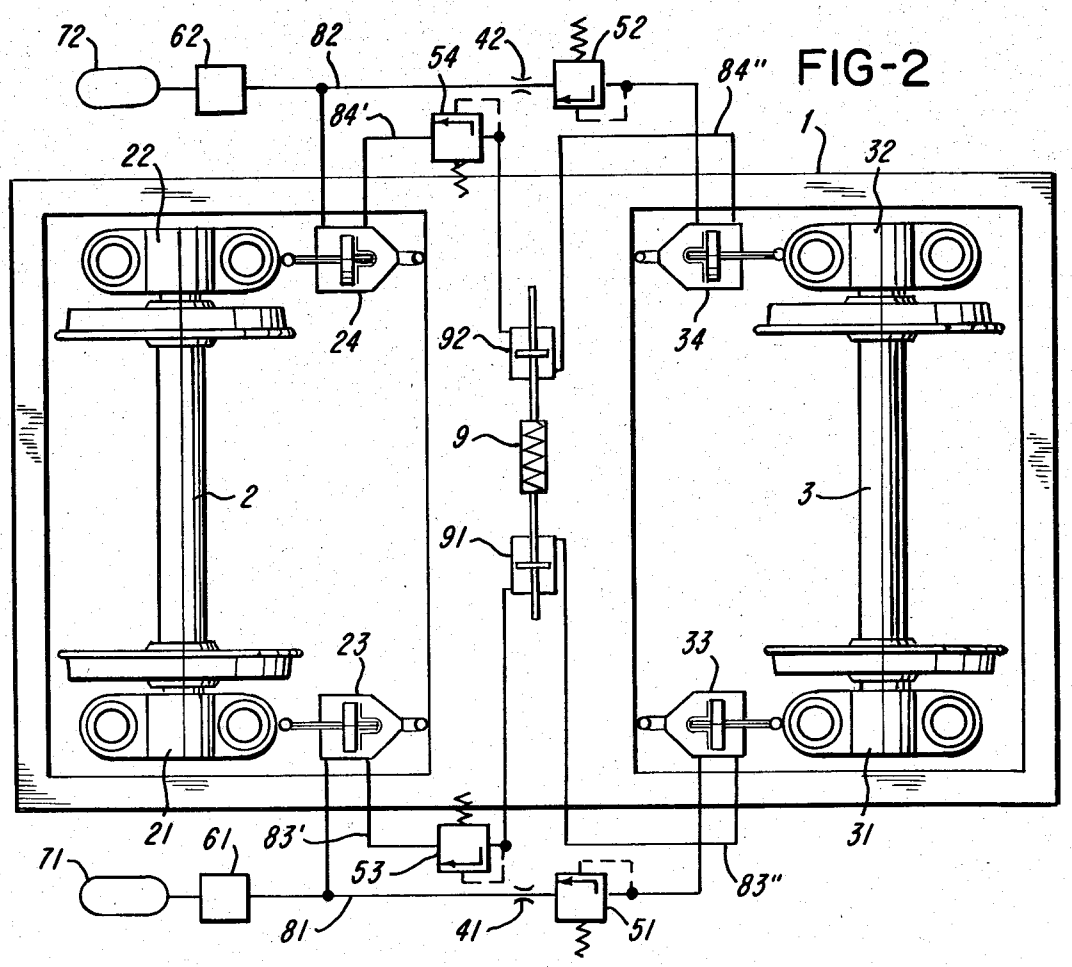
FIG. 2 is a plan view which schematically illustrates a truck frame having two wheel sets and another embodiment of the inventive hydraulic axle control mechanism.

The construction of the embodiment illustrated in FIG. 2 corresponds essentially to that of the embodiment already described. It differs only in that an intermediate hydraulic cylinder 91 or 92 having double acting pistons is interposed in one line on each longitudinal side of the truck frame. Each of the pistons has a piston rod which passes completely through. The ends of these two piston rods which face one another are connected to a mechanical spring element 9. Due to this mechanical spring element 9 between the line sections 83' and 83'' on the one hand, and the line sections 84' and 84'' on the other hand, a synchronization of the piston movements in the four hydraulic cylinders 23, 24, 33, 34 is achieved.

The present invention is, of course, in no way restricted to the specific disclosure of the specification and drawings, but also encompasses any modifications within the scope of the appended claims.

What I claim is:

1. In an axle control mechanism for rail vehicles having at least one truck frame, which has a longitudinal dimension in a predetermined direction and two wheel sets therewith, each wheel set having an axle, and a journal box and journal box housing at each end of each axle; the two journal boxes of a given wheel set being interconnected with the respectively opposite journal boxes of the other wheel set by means of a hydraulic system; a movement of one of the wheel sets automatically bringing about a "self-orienting" movement of the other wheel set; the improvement therewith which comprises:

hydraulic cylinders, each having a double-acting piston with a working chamber, each working chamber including an inner chamber portion connected to the frame and an outer chamber portion on the opposite side of the piston; each hydraulic cylinder being operatively connected via its piston to a respective said journal box housing of the two wheel sets of a given truck frame; said hydraulic cylinders being disposed in longitudinal pairs in the direction of said longitudinal dimension of said truck frame, and effecting connection of the latter to said journal box housings; in a given truck frame, two hydraulic cylinders being successively located in-line on each longitudinal side thereof; and hydraulic lines for respectively interconnecting an inner chamber portion of a given hydraulic cylinder to the outer chamber portion of the other hydraulic cylinder located on the same longitudinal side of said truck frame to establish hydraulic circuit communication directly between said last-mentioned chamber portions so that a piston movement in a given one of the in-line hydraulic cylinders on a given longitudinal side of said truck frame causes an oppositely directed piston movement in the other hydraulic cylinder on that longitudinal side of said truck frame, thus accomplishing coupled opposite turning movements of the two wheel sets of a given truck frame during movements in curve travel.

2. An axle control mechanism according to claim 1, in which said pistons include piston rods, and in which connections for said hydraulic cylinders and said piston rods are arranged as Cardanic and flexible.

3. An axle control mechanism according to claim 1, in which the hydraulic cylinders on the same longitudinal side of a given truck frame form a hydraulic circuit system; and which includes a reservoir for hydraulic pressure medium connected to each of said hydraulic circuit systems; and a control valve interposed between the hydraulic circuit system and its reservoir.

4. An axle control mechanism according to claim 3, which includes two of said hydraulic lines for each hydraulic circuit system of a given truck frame, and a relief valve in each of said hydraulic lines.

5. An axle control mechanism according to claim 4, which includes a flow restrictor operatively connected in at least one of said hydraulic lines of each hydraulic circuit system.

6. An axle control mechanism according to claim 5, in which one of said hydraulic lines of each hydraulic circuit system comprises two line sections; which includes a respective hydraulic intermediate cylinder interposed between each pair of line sections; each of said intermediate hydraulic cylinders having a double-acting piston with a piston rod that passes therethrough one end of the piston rod of one intermediate hydraulic cylinder facing an end of the piston rod of the intermediate hydraulic cylinder of the other hydraulic circuit system; and which includes a mechanical spring element for functionally connecting those ends of said last-mentioned piston rods which face one another to achieve a synchronization of the piston movements in said hydraulic cylinders of said hydraulic circuit systems of a given truck frame.

* * * * *